United States Patent [19]

Samuelsson

[11] Patent Number: 4,571,758

[45] Date of Patent: Feb. 25, 1986

[54] APPARATUS FOR VERTICALLY LIFTING AND RADIALLY MOVING A PERSON OVER A SUPPORTING SURFACE

[75] Inventor: Frank A. Samuelsson, Redwood City, Calif.

[73] Assignee: United Air Lines, Inc., Elk Grove Township, Ill.

[21] Appl. No.: 528,223

[22] Filed: Aug. 31, 1983

[51] Int. Cl.[4] ..... A61G 7/10

[52] U.S. Cl. ..... 5/86; 5/87; 4/460; 4/461

[58] Field of Search ..... 5/81 R, 81 B, 83, 85, 5/86, 87, 88; 4/460–466; 414/921

[56] References Cited

U.S. PATENT DOCUMENTS

| | | | |
|---|---|---|---|
| 430,642 | 6/1890 | Hale | 5/87 |
| 562,725 | 6/1896 | Hepburn | 5/87 |
| 935,170 | 9/1909 | Smith | 5/87 |
| 1,018,723 | 2/1912 | Miller et al. | 5/87 |
| 2,844,187 | 7/1958 | Scoville | 5/81 R |
| 3,918,108 | 11/1975 | Feyerherm | 5/86 |
| 4,117,561 | 10/1978 | Zamotin | 5/88 |
| 4,372,452 | 2/1983 | McCord | 5/85 |

FOREIGN PATENT DOCUMENTS

| | | | |
|---|---|---|---|
| 2414909 | 9/1979 | France | 5/81 R |

*Primary Examiner*—Alexander Grosz

*Attorney, Agent, or Firm*—Neuman, Williams, Anderson & Olson

[57] ABSTRACT

A novel lifting and carriage apparatus to lift, support, and move heavy objects about in close or crowded environments is provided with a cantilevered arm support means to support the object, a means for rotating the arm and a means to lift and lower the arm. The rotation and lifting functions may be accomplished by motorized means. The apparatus is attachable to a floor mounted base plate and may be easily removed and secured to another base plate.

7 Claims, 9 Drawing Figures

FIG. 1
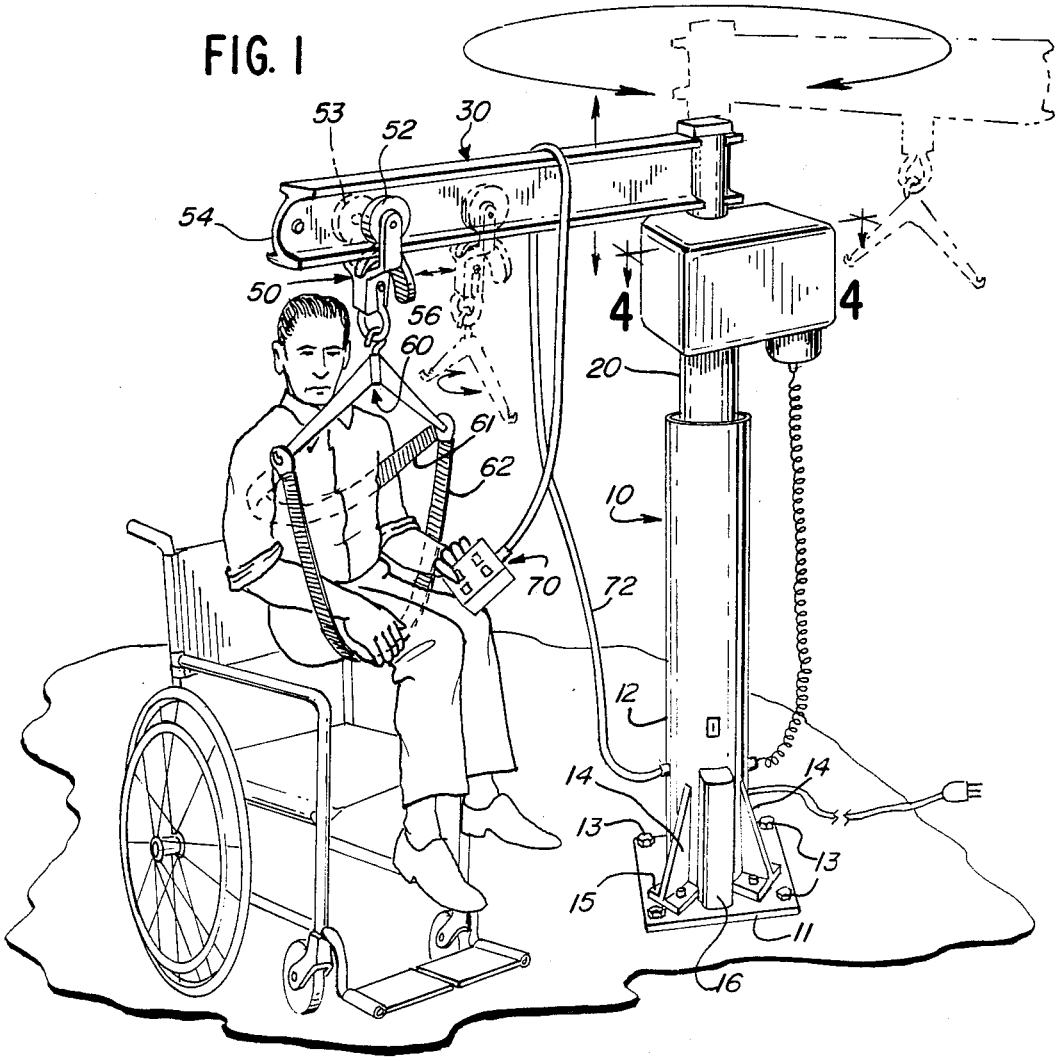
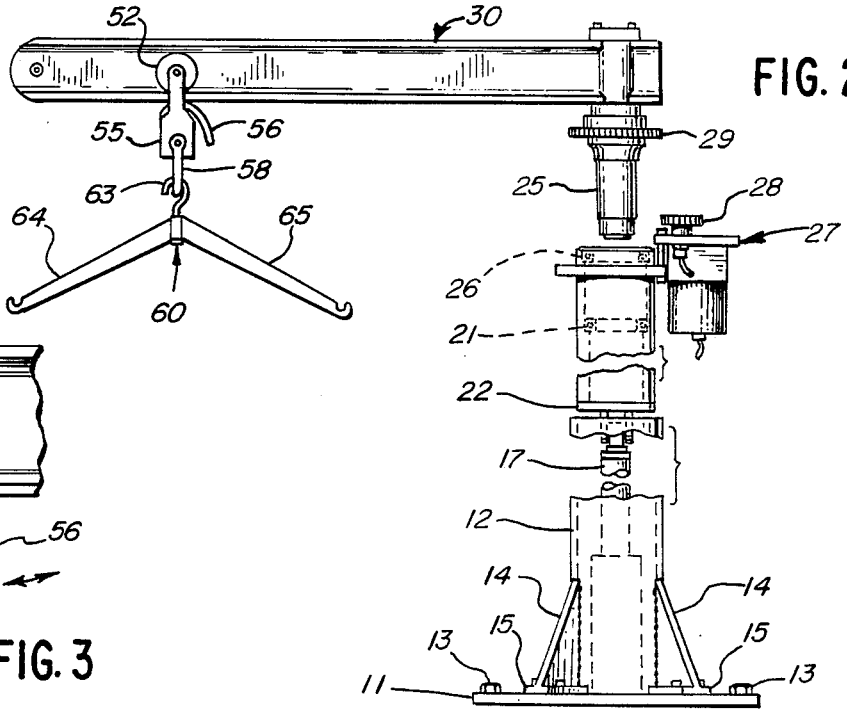
FIG. 2
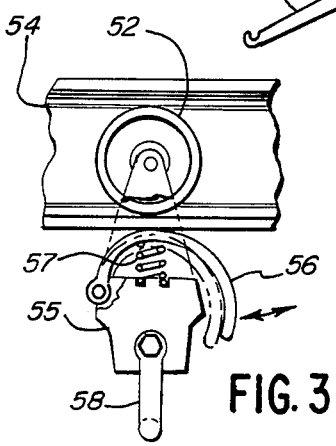
FIG. 3

FIG. 4
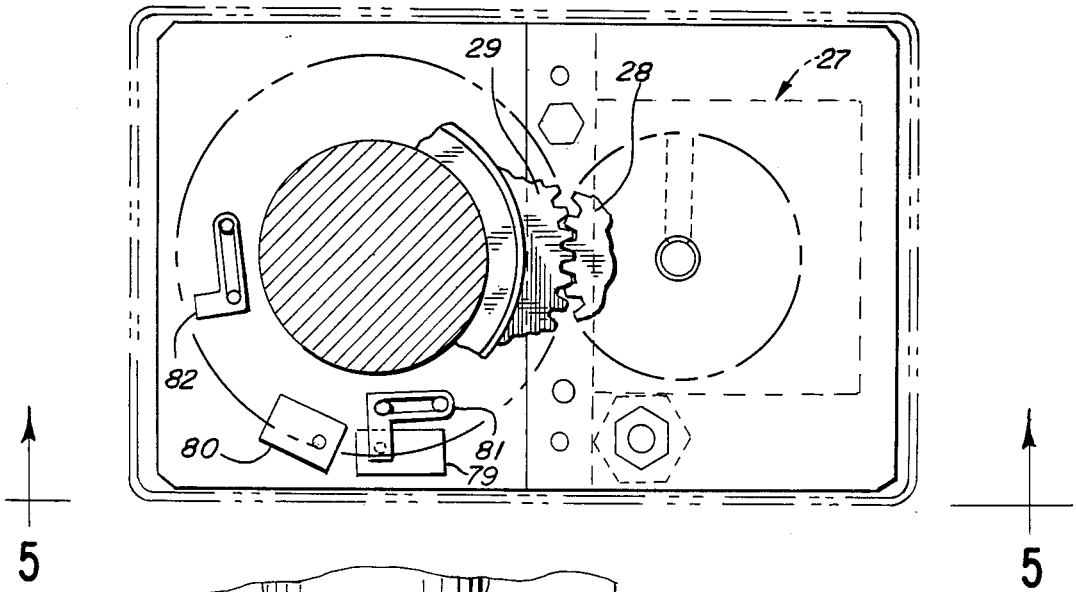
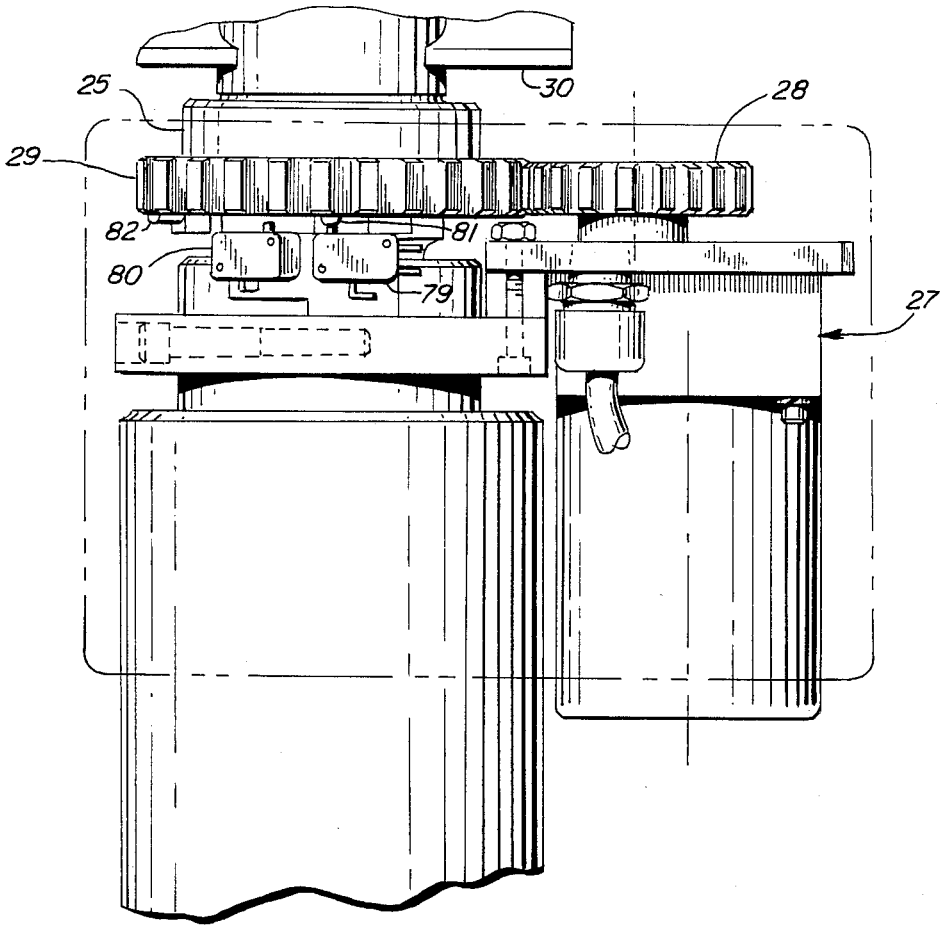
FIG. 5

FIG. 7
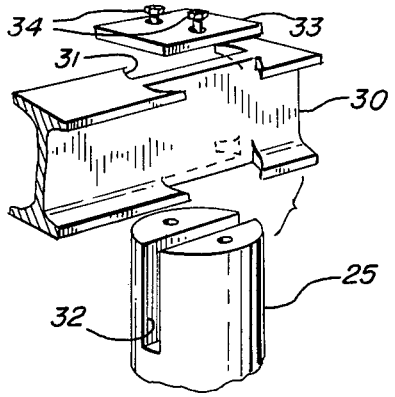
FIG. 6
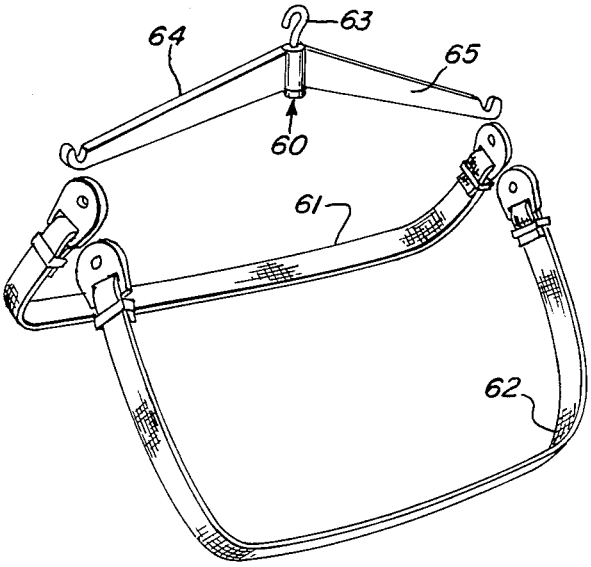
FIG. 8
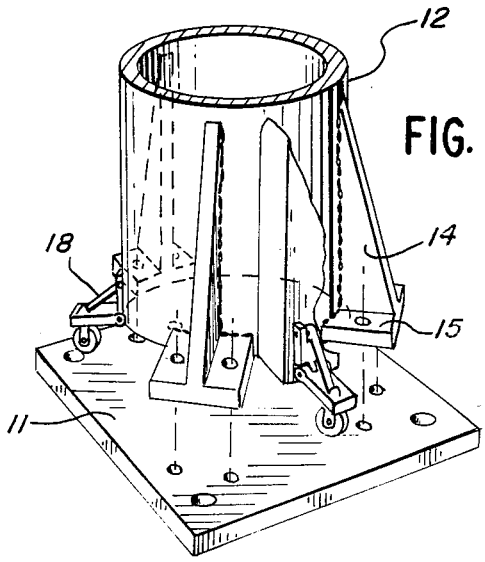
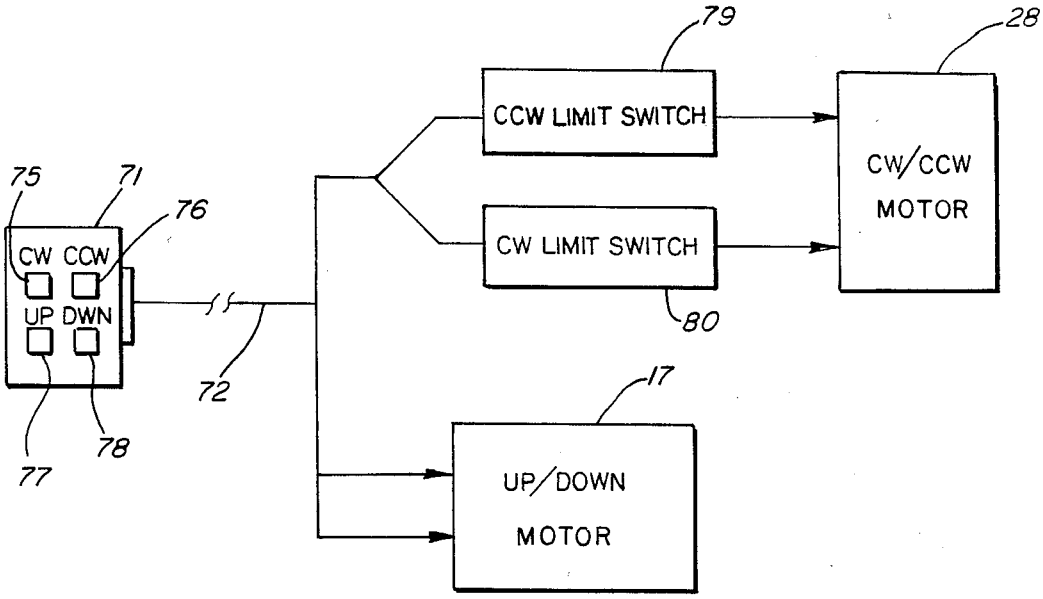
FIG. 9

APPARATUS FOR VERTICALLY LIFTING AND RADIALLY MOVING A PERSON OVER A SUPPORTING SURFACE

BACKGROUND OF THE INVENTION

This invention relates generally to the carriage of heavy objects about in relatively close quarters. More particularly, this invention relates to the transporting of heavy objects over stationary barriers or from one fixed resting point to another in crowded confines. It is particularly useful where the object to be moved would require the assistance of several individuals and would necessitate such individuals to lift and transport such objects while in awkward positions.

The need for movement of heavy objects in a crowded environment may exist in a number of everyday settings. One situation to which the present invention is particularly adapted is the movement of disabled or injured individuals in a variety of their everyday activities. Movements of such a patient between bed and a wheel chair, between a wheelchair and bathing and toilet facilities, and between a wheel chair and a stationary chair are often problematic. Where a disabled or injured individual lacks a high degree of upper body strength such movements may only be made with the assistance of one or more strong individuals who in effect lift and carry the individual from one place to another. For such individuals, who are often rendered disabled as the result of paralyzing injury or the onset of degenerative afflictions such as Muscular Dystrophy, Alzheimer's Disease, and Amyotropic Lateral Sclerosis, movement of the type described creates a substantial dependence on others. This limits a disabled individual's ability to move to only such times when one or more persons are available to move him.

Other patient movement devices are available and known in the prior art, but most are either hydraulic or ratchet jack actuated. The latter results in abrupt movement and is therefore totally unsatisfactory for the movement of patients.

Another environment calling for the carriage of heavy objects in close and crowded quarters is automotive and machinery workshops. The lifting of an automobile engine from a car to a workbench often involves many of the same awkward lifting problems encountered in moving patients. Other lifting and carriage devices have been used in the workshop setting but these most often involve ceiling hoists or tripod arrangements placed over the car. The former of these requires permanent integration into a building structure, while the latter must be assembled around a car for each use and requires excess space and inconvenience.

OBJECTS OF THE INVENTION

It is an object of this invention to provide improvements in the movement of heavy objects in close or crowded quarters which will overcome or substantially reduce the aforementioned problems.

More specifically it is an object of this invention to provide improvements in the means of movement of disabled or injured individuals in and around crowded quarters.

It is another object of this invention to provide a carriage means by which a disabled or injured individual may move him or herself from a wheel chair to a bed, toilet or bathing facilities and vice-versa without the assistance of others.

A further specific object of this invention is to provide an improved means by which heavy objects may be easily moved about.

Other and further objects of this invention will become apparent to those skilled in the applicable arts from the detailed description of a preferred embodiment of the apparatus for use in accordance with the present invention.

SUMMARY OF THE INVENTION

According to one embodiment of this invention a disabled or injured individual or some other heavy object may be lifted and supported on a cantilevered support arm, rotated upon that arm about a vertical axis and moved radially along that arm. The apparatus may be attached to the floor by means of a base plate to which the rest of the apparatus may be easily detached and moved for attachment to another base plate. A cylindrical support column, which attaches to the base plate, houses another cylindrical column which may be raised and lowered by means of a vertical motor. A cylindrical shaft is housed within this vertically moveable column by means of radial bearings so that it may rotate about its vertical axis. Attached to this cylindrical shaft to form a cantilevered support arm is an I-beam. This arm may be equipped with a motorized means to rotate the cylindrical shaft and support arm. The support arm may be equipped with a hook at the end to support an individual or object at that point. Alternatively a trolley support means may be used on the I-beam with which the individual or object may be moved radially along the support arm.

When supporting a disabled or injured individual, a body support hanger and a pair of harness straps are used to support the individual in a generally sitting position. The harness straps are easily attachable behind and underneath an individual with a minimal amount of shifting of weight on the part of the disabled individual.

The motorized functions of the apparatus are operated by means of a hand-held control mechanism. This mechanism may be operated by the individual being supported by the apparatus or by an attendant assisting the disabled individual.

DESCRIPTION OF THE DRAWINGS

FIG. 1 is a perspective view of the lifting and carriage apparatus of the present invention illustrating a patient supported by the apparatus and having arrows indicating the freedoms of motion.

FIG. 2 is a partially cutaway view of the lifting and carriage apparatus of the present invention illustrating the vertical and rotational motive means.

FIG. 3 is a partially cutaway view of an I-beam support arm and trolley support means.

FIG. 4 is an enlarged cross-sectional view of the rotational motive means taken along line 4—4 of FIG. 1.

FIG. 5 is a cross-sectional view along line 5—5 of FIG. 4.

FIG. 6 is a view of the body support hanger and a pair of harness straps for use to support an individual on the apparatus.

FIG. 7 is an exploded, partially cutaway view illustrating the attachment of the I-beam to the cylindrical shaft.

FIG. 8 is an exploded, partially cutaway view illustrating the attachment of the cylindrical support column to the base plate.

FIG. 9 is a block illustration of the control mechanism and the circuit configuration for the motorized means for vertical and rotational movement.

It should be understood that the drawings are not necessarily to scale and that the embodiment is sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiment illustrated herein.

DETAILED DESCRIPTION OF A PREFERRED EMBODIMENT

As seen in FIG. 1, a disabled or injured individual is being supported above his wheelchair by means of an apparatus for lifting and carriage of disabled or injured individuals 10. The apparatus generally comprises a base plate 11, a cylindrical support column 12, a cantilevered support arm 30 and an attachment means 50. Each of these components is discussed in detail in the following description, with references to the drawings.

As illustrated, a base plate 11 is adapted so that it may be fixed to the floor by means of four corner bolts 13. A base plate of dimensions of twelve inches by twelve inches is sufficient to provide appropriate support for the apparatus. In situations where the apparatus might be used in more than one location, it may be quite appropriate to secure a base plate at each of those locations, and merely move the rest of the apparatus to that location where its use is presently desired. Where the floor is masonry the base plate may readily be secured by the four bolts 13. On wood floors or the like, it is preferred that the bolts pass through a matching plate beneath a joist with fastening nuts to clamp the joist.

The ease with which the apparatus may be thusly moved is facilitated by means of a very simple attachment mechanism. The cylindrical support column 12 is equipped at its base with gussets 14 and gusset plates 15. (see FIG. 8) On each gusset plate is a pair of holes by which the apparatus may be bolted to the base plate. By simply removing these bolts the apparatus may then be moved to another location and quickly bolted to another base plate.

Movement of the apparatus from one location to another may be further facilitated by means of a wheeled support means 18 attachable to the support column. When the bolts attaching gusset plates 15 to base plate 11 are removed the entire apparatus may be wheeled to the location of another base means. This feature may be retractable when the apparatus is attached to the base plate so that it fits within the vertical envelope of the edge of the base plate.

Situations may exist, however, where the apparatus may not be mountable on a base plate as shown in FIGS. 1, 2 and 8. Alternative means, such as wall mounting brackets attached around the cylindrical support column, may be used as the situation dictates.

Located at the base of cylindrical support column 12 is housing 16 for the vertical motive means 17. This feature should be relatively compact so that the housing will fit within the vertical envelope above the edges of the base plate. While any of a number of commonly known compact motorized means may be used to accomplish the vertical movement function, a linear actuator has proved to be effective. It performs the rising and lowering function by means of a central lead screw rotating through a threaded housing. It is easily supported in cylindrical support column 12 and housing 16 by means of side pins and trunion mounts. A linear actuator having a twelve inch stroke may be satisfactory for moving many objects or individuals, however, an actuator having an eighteen inch stroke may be more effective for moving adult individuals.

Referring now to FIGS. 1 and 2, cylindrical load lifting column 20 is housed within cylindrical support column 12 when the apparatus is in its lowest vertical position. The cylindrical load lifting column is supported by means of radial bearings 21 and by cylindrical plate 22, the latter of which is attached to the vertical motive means. For an embodiment which is capable of performing all the freedoms of motion described herein with a load of two hundred and fifty pounds, a five inch diameter cylindrical support column 12 and a four inch diameter cylindrical load lifting column 20 have been proven to be satisfactory.

Rotatably housed within cylindrical load lifting column 20 is cylindrical shaft 25. The cylindrical shaft is supported in cylindrical load lifting column 20 by means of radial bearings 26. The apparatus, however, may be equipped with a motorized means for rotational movement 27 of the cylindrical shaft. As shown in FIGS. 2, 4 and 5, gear motor 28 is used to drive gear 29, which is disposed upon cylindrical shaft 25. Gear motor 28 is mounted on the outside of cylindrical load lifting column 20, and may be used to rotate cylindrical shaft 25 at any height in the vertical movement cycle.

Referring now to FIGS. 4 and 5, drive gear 29 is capable of 360° rotation. It may, however, be desirable to limit the degree of rotation. For instance, where the apparatus is set near to a wall it would be desirable to limit the rotation so that the cantilevered support arm, or an individual supported by the apparatus does not contact the wall. To accomplish this, limit switches may be placed near the drive gear, such as those illustrated as 79 and 80. When actuated, limit switch 79 trips the counterclockwise motor circuit (illustrated in FIG. 9), thereby preventing rotation in that direction. Similarly, limit switch 80 trips the clockwise motor circuit. Limit switches 79 and 80 are actuated by switch actuators 81 and 82, respectively. Switch actuators 81 and 82 may be set at any two desired points around drive gear 29. As shown in FIG. 4, these actuators are set approximately 270° apart. When these actuators are set in their furthest settings, there would then be a maximum rotation of approximately 350°.

Cantilevered support arm 30 is attached to the top of cylindrical shaft 25. As shown in the illustration an I-beam is used as the cantilevered support arm. As can be seen in FIG. 7, the attachment to the cylindrical shaft is accomplished by means of a notch 31 cut in one end of the I-beam and a notch 32 cut in the top of the cylindrical shaft. A shaft cap 33 holds the I-beam in place by means of two set screws 34 fixing the cap to the shaft. In this arrangement the cantilevered support arm is capable of 360° rotation, either through the operation of the gear motor in one embodiment, or by manual rotation in an embodiment without a motorized means of rotation.

Supported by cantilevered support arm 30 is attachment means 50 which is to be used to attach and support a heavy object. For used of the apparatus which would not call for radial movement, the attachment means may be permanently fixed to the end of the cantilevered support arm. The apparatus may however be equipped with an attachment means to move the object or person being supported along the length of the cantilevered support arm.

The trolley support means, illustrated in detail in FIG. 3 provides a moveable support means which may be operated by an individual supported in the apparatus, while not requiring a great deal of strength to accomplish the movement. The trolley support means is equipped with a pair of wheels 52, 53 which can be rolled along the lower plate of I-beam 54. Axle member 55 which is of a generally Y-shape provides an axle means for the wheels. Breaking means 56 braces against the bottom of the I-beam, and is held in the braced position by compression spring 57. When the breaking means is depressed to a position indicated by the phantom lines of FIG. 3, the wheels are free to roll along the I-beam, carrying the object or individual supported radially along the path of the trolley support means. When the breaking means is released the wheels may roll with relatively little resistance. Because of this feature, an individual being supported in the apparatus who has strength in both arms may move along the path of the I-beam unassisted. When one hand releasing the breaking means, the other hand is free to grasp the top of the I-beam to push or pull him/her self to a desired radial position. At the base of the Y-shaped axle member is attached a weight attachment means 58, such as a loop or a hook.

As can be seen in FIG. 1 a disabled or injured individual is supported on the apparatus by means of body support hanger 60 and a pair of harness straps 61, 62. The body support hanger attaches to the weight attachment means 58 by means of hooking means 63, located at the center of the body support hanger. The two arms 64, 65 of the body support hanger are each adapted to receive the ends of the two harness straps.

As can best be seen in FIG. 6 the harness straps can be easily arranged to support an individual without that individual having to shift his/her weight to any great degree. One harness strap is placed behind the individual's back and under each arm. The other harness strap supports the individual from under the buttocks by sliding it under the legs. The ends of each harness strap may then be easily secured to the arms of the body support hanger directly in front of the individual to be supported. This greatly increases mobility for disabled or injured individuals who have use of their hands and arms but do not have sufficient upper body strength to support their body weight. By merely slipping one harness strap behind him/her self and one under him/her self and securing the straps to the body support hanger, he/she may make use of the apparatus to move about.

Once the harness straps are in place and secured as just described, and individual may than activate and control the apparatus by use of control mechanism 70. As can be seen in FIG. 1 this control mechanism may be in the form of a control box 71, connected to cylindrical support column 12 through cord or bus 72. The length of cord of bus 72 should be sufficient to reach an individual being supported in the most remote extension of the apparatus. It should, likewise, be sufficiently long enough to reach an attendant outside of the path of movement of an individual supported by the apparatus.

The control box is an easily operable four button unit. Two button switches 75, 76 control gear motor 28 directing clockwise and counterclockwise movement of cantilevered support arm 30. The depression of one of the switches 75 or 76 provides an output signal on cord or bus 72 and through limit switches 79 and 80. When either of these switches is mechanically activated as previously described, this terminates the signal, thus shutting off rotational motive means 27. Two additional button switches 77, 78 control vertical motor 17 directing the upward and downward movement of the cylindrical load lifting column 20. The depression of one of the switches 77 or 78 provides an output signal on cord or bus 72 to vertical motor 17. A block diagram of the circuitry of the two motors and the control mechanism is shown in FIG. 9 and since the operation of motors of this type is well understood in the art, only a general block diagram of the motor circuit is considered necessary.

In some embodiments of the invention, certain features shown in FIG. 9 would not be necessary. For example, in a simplified embodiment, the rotational motive means 27, is not incorporated. Consequently, only the schematic circuitry shown to be connecting the linear actuator would be used. Also control box 71 would only include switches 77 and 78 for upward and downward movement respectively.

In another embodiment, even though it uses a motorized means for rotational movement, it might be desirable to eliminate limit switches 79 and 80, thereby permitting unrestricted rotational movement.

While the invention has been described and illustrated indicating the application of this apparatus for the transposition of disabled or injured individuals it should be obvious that a great number of alternative uses exist. For instance, it may be easily adapted for use in many of those situations where a heavy object must be moved in a close or crowded environment. Machine workshops, automotive repair garages, and production assembly lines are several of the envisioned situations where the present invention would find useful application. It is thus thought that the invention and many of its attendant advantages will be understood from the foregoing and it will be apparent that various changes may be made in form, construction and arrangement thereof without departing from the scope and spirit of the invention.

What I claim is:

1. Apparatus for vertically lifting and both radially and linearly moving a person over a supporting surface comprising:

base means for fixed attachment to a supporting surface;

a substantially hollow cylindrical support member releasably attached to said base means and extending substantially upward therefrom;

a substantially cylindrical load lifting member positioned inside said support member;

vertical motive means connected to said load lifting member for vertically moving said load lifting member relative to said support member;

an upper member connected to said load lifting member for rotation relative thereto; and having a notched opening for receiving a cantilevered load support arm; radial bearing means for connecting said upper means to said load lifting member;

a cantilevered I-beam load support arm connected to said upper member and extending radially therefrom so that said load support arm is moveable relative to said load lifting means;

a trolley support means connected to and subtending from said support arm for linear movement along the length of said support arm;

and a harness means for holding the person connected to said trolley means.

2. Apparatus as defined in claim 1, wherein said trolley support means comprises a pair of wheels, one wheel being disposed on each side of the upright portion of said I-beam and each wheel being positioned on the lower cross position of said I-beam, and axle member having a generally Y-shape, each one of the upper branches of said axle member being connected to one of said wheels, a weight attachment means connected to the straight branch of said axle member, and a braking means connected to said axle member for controlling the position of said trolley support means along said cantilevered load support arm.

3. Apparatus according to claim 1 wherein said harness means comprises a body support hanger having two arms, harness straps, each of said arms being attachable to one end of said harness straps and a hooking means connected to said body support hanger for attachment to said trolley support means.

4. Apparatus as defined in claim 3 wherein one of said harness straps is adapted to support an individual from behind the back and another of said harness straps is adapted to supporting an individual from beneath the buttocks.

5. Apparatus as defined in claim 4 further comprising hand-held control mechanism connected to said apparatus for controlling said vertical motive means and said rotational motive means.

6. Apparatus as defined in claim 5 wherein said hand-held control mechanism comprises a control box having a plurality of switching means mounted thereon which when activated provide electrical signals to said vertical motive means and said rotational motive means.

7. Apparatus as defined in claims 1, further comprising a wheeled support means attached to said support member for movement of said apparatus when detached from said base plate.

* * * * *